United States Patent [19]

Emigh et al.

[11] Patent Number: 4,967,558

[45] Date of Patent: Nov. 6, 1990

[54] STABILIZED FREE-PISTON STIRLING CYCLE MACHINE

[75] Inventors: S. Grant Emigh; Maurice A. White, both of Richland; Peter Riggle, Kennewick, all of Wash.

[73] Assignee: Stirling Technology Company, Richland, Wash.

[21] Appl. No.: 386,539

[22] Filed: Jul. 27, 1989

[51] Int. Cl.[5] ..... F02G 1/04

[52] U.S. Cl. ..... 60/520

[58] Field of Search ..... 60/520

[56] References Cited

U.S. PATENT DOCUMENTS 3,986,360 10/1976 Hagen et al. ..... 60/520
4,532,766 8/1985 White et al. .

OTHER PUBLICATIONS

"Conceptual Design and Cost Analysis of Hydraulic Output Unit for 15KW Free-Piston Stirling Engine," White, Aug., 1982, title page through page 20.
Shaltens, "Advanced Stirling Conversion Systems for Terrestrial Applications," Mar. 22-27, 1987.
White et al., SAE paper 870104 "Practical Bellows Seals for Stirling Engines," Feb. 23-27, 1987.
Riggle, "Stability Characteristics of Stirling Engines," paper number 859386, Intersociety Energy Conversion Engineering Conference, Aug. 1985, pp. 3.313-3.319.
Riggle et al., "Stirling Engine Analysis Insights Derived from Sixteen Years of Artificial Heart Power Source Development," paper number 839124, Intersociety Energy Conversion Engineering Conference, Aug. 1983, pp. 766-772.
"Design of a Hydraulic Output Stirling Engine", Harvey et al., IECEC 1982 Proceeding, IECEC Paper No. 829294,pp. 1772-1777.

*Primary Examiner*—Allen M. Ostrager
*Attorney, Agent, or Firm*—Wells, St. John & Roberts

[57] ABSTRACT

A free piston Stirling cycle machine is illustrated by an engine that utilizes an axially movable displacer subjected to working gas pressures. A primary hydraulic circuit hydrostatically couples a displacer drive rod integral with the displacer to a counterbalance illustrated in the form of a scotch yoke. The counterbalance stabilizes and controls the Stirling cycle engine by constraining the displacer's reciprocating axial motion in a repetitive pattern. A throttling valve interposed in the primary hydraulic fluid circuit is used to adjustably resist displacer motion as required by engine operating conditions. A secondary hydraulic circuit is provided together with a bellows assembly between the working gas and power pistons to convert changes in working gas pressure to usable power output in the form of pumped hydraulic fluid.

12 Claims, 8 Drawing Sheets

STABILIZED FREE-PISTON STIRLING CYCLE MACHINE

The Government has rights in this invention pursuant to Contract No. DEN3-371 awarded by the U.S. National Aeronautics and Space Administration.

TECHNICAL FIELD

This invention relates to improvements in a Stirling engine or heat pump in which the displacer of the Stirling machine is balanced and stabilized by a counterbalance assembly hydraulically coupled to it.

BACKGROUND OF THE INVENTION

This invention arose from an effort to utilize free piston Stirling engine technology for conversion of solar energy to electrical power. The free piston engine produces high pressure hydraulic flow which powers a commercial hydraulic motor that in turn drives a commercial rotary induction generator. The engine development required a high confidence design for a free piston Stirling engine system. Design goals included long projected engine life, high efficiency, minimum life cycle cost, dynamic balancing, minimum weight, heat pipe or reflux boiler thermal transport, a self-contained cooling system, and automatic control.

The approach used to achieve these objectives employed a hermetically sealed Stirling hydraulic engine concept. The basic elements of such engines and their critical components have demonstrated long operating times in supporting experimental work. The described engine concept provides full film hydrodynamic lubrication of all sliding parts, simple construction with conventional automotive manufacturing tolerances, hydraulically coupled counterbalancing, and simple, but effective, power control to optimally follow variations in solar heat input. A novel stabilizer disciplines the reciprocating movement of the displacer to provide control and stabilization functions not previously achieved in free piston Stirling machines.

In the described example for use with solar energy as the heat source for the engine, a suitable concentrator (parabolic reflector) reflects insolation for absorption in a receiver, where it is transferred to the Stirling engine heater head by a simple, rugged and reliable liquid metal pool boiler. Pulsatile hydraulic flow from the Stirling hydraulic engine is smoothed by a pulsation suppressor for use by a hydraulic motor. Engine waste heat is rejected to the atmosphere by a heat exchanger. A simple, energy conservative, automatic control system can be used to adjust engine power to maintain constant hot end temperature in the Stirling engine over a wide range of insolation power levels. The output shaft of a variable displacement hydraulic motor can be coupled directly to an induction generator for producing properly conditioned electrical power. The heat exchanger, surge suppressor, hydraulic motor, and induction generator are all proven, reliable, commercially available components.

BRIEF DESCRIPTION OF THE DRAWINGS

The preferred embodiments of the invention are illustrated in the accompanying drawings, in which:

FIG. 6 is an enlarged sectional view taken along line 6—6 in FIG. 5;

FIG. 8 is a sectional view taken along line 8—8 in FIG. 5.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

The present invention relates to a Stirling cycle machine, which can either be an engine or a heat pump. Like all Stirling cycle machines, the embodiments of this invention disclosed and described below are reversible. However, the specifically described embodiments forming this disclosure are directed to Stirling engine applications.

Figure 1:
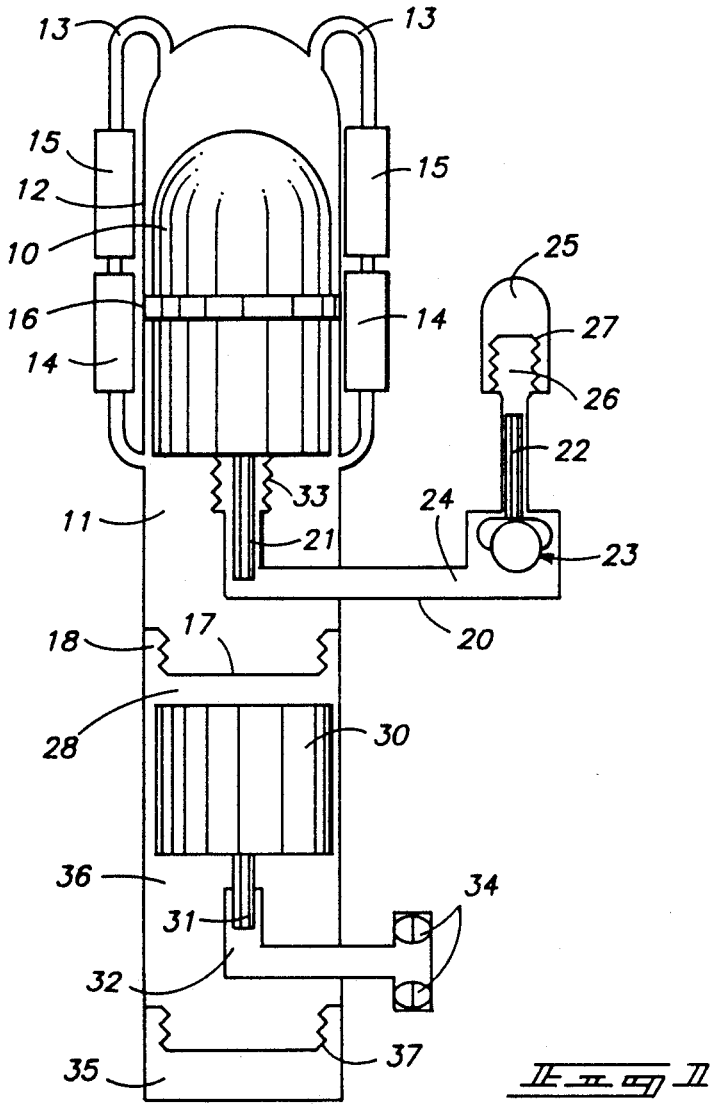
FIG. 1 is a simplified schematic view of the machine.

FIG. 1 is a simplified schematic view of the basic components of a Stirling cycle engine incorporating the present invention. The free piston Stirling cycle machine shown in FIG. 1 includes a movable displacer 10 that is responsive to changes in working gas pressure. A displacer drive rod 21 is fixed to and moves in unison with displacer 10 and is sealed by a bellows 33.

Displacer 10 has a central cylindrical axis and is located within a displacer cylinder 12 formed in a supporting engine housing 20. As is conventional in Stirling cycle machines, displacer 10 is surrounded by working gas means, illustrated schematically as a gas heater 13, a gas cooler 14, a regenerator 15, and a displacer cylinder 12.

The working gas means includes an enclosed volume of pressurized working gas, such as helium, which is directed to the ends of displacer 10 for cyclically reciprocating displacer 10 along its axis in a Stirling cycle mode of operation in conjunction with a gas spring 25 and the interconnecting mechanism described below. An annular clearance seal 16 formed circumferentially about displacer 10 separates the hot and cool working gas regions to which the axial ends of displacer 10 are exposed.

The Stirling cycle mode of operating such machines is well known. No further details relating to Stirling cycle function is believed necessary in order to describe the machine environment for which the present invention was designed.

Stability of a free piston Stirling engine can be loosely defined as oscillation in the periodic steady state. Stability problems can include dropout, a condition in which amplitudes of oscillation decrease until engine oscillations cease; blowup, a condition in which oscillations increase until limited by displacer or power piston collisions; and hunting, a condition in which the amplitude and/or frequency periodically increase and decrease, or the amplitude is temporarily limited during control transients.

A counterbalance rod 22 is mounted for axial reciprocating motion relative to a supporting cylinder that can be formed integrally with housing 20 or separate from it. Rod 22 is part of a counterbalance that is mechanically supported by a stabilizer 23. Stabilizer 23 can take many forms, including a conventional rotary crank and connecting rod assembly or a scotch yoke mechanism. Stabilizer 23 cyclicly constrains or disciplines the reciprocating motion of the counterbalance rod 22 in a repetitive pattern.

Stabilizer 23 eliminates the stability and control problems that often complicate operation of non-stabilized free piston Stirling engines. It avoids limited and difficult control of power output, dropout of oscillations at low power levels, destructive collisions resulting from overstroking, and difficulty in debugging engines because of stability and control problems.

A primary hydrostatic fluid circuit operatively couples the displacer and counterbalance. The primary hydrostatic fluid circuit includes both the volume of hydraulic fluid 24 that hydrostatically couples the displacer drive rod 21 to the counterbalance rod 22 and the volume of hydraulic fluid 26 which couples counterbalance rod 22 to gas spring 25.

The gas spring 25 is operably connected to the hydrostatic fluid means for accommodation fluid volumetric displacement due to engine operation.

Reciprocating movement of the counterbalance rod 22 is sustained by the enclosed volume of pressurized hydraulic fluid 26 and the gas spring 25 operating in conjunction with cyclic variations in engine gas pressure. The hydraulic fluid 26 and the volume of gas at 25 are separated by a bellows 27, which acts as a sealing diaphragm.

External power is derived from the engine through a reciprocable power piston 30 that includes a smaller diameter intensifier piston 31. Power piston 30 delivers net cyclic work output as a direct function of working gas pressure fluctuations. Piston 31 is located within a pump chamber 32 connected to a hydraulic power output through conventional check valves 34.

A secondary hydrostatic fluid circuit operatively couples the displacer and power piston 30. The secondary hydrostatic fluid circuit includes both the volume of hydraulic fluid 28 that has working gas pressure applied directly to it through a movable cold wall 17 supported by sealing bellows 18 and the volume of pressurized hydraulic fluid 36 that couples power piston 30 to gas spring 35. The pressurized hydraulic fluid 36 sustains reciprocation of power piston 30 and is subjected to the pressure of gas spring 35, which is separated from the fluid 36 by bellows 37.

The compressible gas springs 25 and 35 accommodate displacement of the primary and secondary hydrostatic fluid circuits during operation of the engine.

Figure 2:
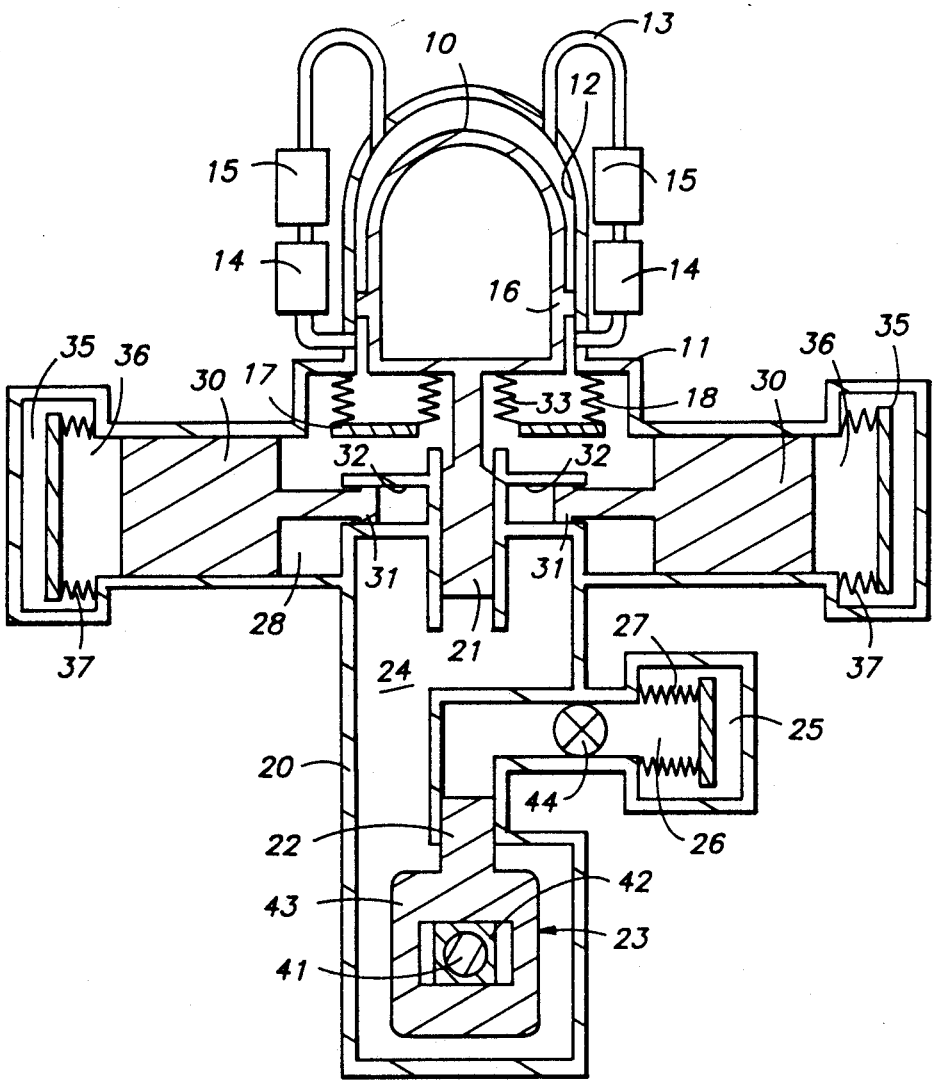
FIG. 2 is a schematic view of one form of the machine.

FIG. 2 schematically illustrates the displacer and counterbalance in an axially aligned and opposed configuration within engine housing 20. Components that are common to the preceding disclosure are identified by reference numerals identical to those presented in FIG. 1.

As shown in FIG. 2, the reciprocating displacer 10 is coaxially aligned with the counterbalance rod 22. Counterbalance rod 22 is mechanically constrained by the stabilizer 23. Stabilizer 23 is shown as a supporting scotch yoke mechanism that includes an eccentric crank pin 41, a slider 42 and a surrounding yoke 43.

The displacer assembly, including displacer 10 and displacer drive rod 21, preferably has a mass and stroke substantially equal to those of the counterbalance assembly, which includes the counterbalance rod 22 and the surrounding yoke 43. The cross-sectional area of displacer drive rod 21 is shown as being equal to that of counterbalance rod 22.

Stabilizer 23 prevents damaging overstroking of displacer 10, and consequently the power piston or pistons 30, under all operating conditions and loads. The engine is perfectly counterbalanced by the resulting equal and opposite reciprocating motion of the coaxial displacer components and counterbalance components, which have both equal mass and stroke.

It should be recognized that it is not always essential to utilize identical masses in the construction of the displacer and counterbalance components as described above. The counterbalance parameters—mass, rod diameter, and stroke length—can be sized differently from the corresponding parameters of the displacer assembly and still achieve desired balance and required displacer stroke length. The crucial requirement of such design is that the stroke volumes of the displacer drive rod 21 and the counterbalance rod 22 must be substantially equal to one another and their vertical inertial forces must substantially balance.

FIG. 2 also illustrates the interposition of a variable valve 44 within the volume of hydraulic fluid 26 that hydrostatically couples counterbalance rod 22 with bellows 27 and gas spring 25. Valve 44 acts as "throttle valve means" to adjustably resist displacer motion by restricting the flow of hydraulic fluid in the primary hydraulic fluid circuit.

Valve 44 controls power output of the engine. It resists displacer motion to vary engine speed. This can be used to modulate heat input temperature and power output in a manner that maintains high cyclic efficiency.

The inclusion of valve 44 in the hydraulic fluid circuit 26 provides the user with the ability to match operation of an engine to its output demand. In the case of an engine powered by an uncontrollable source of heat, such as solar energy, engine efficiency is maintained by adjusting output to maintain a constant heat input temperature for the engine. Where the source of heat is controllable, one can use valve 44 to adjust engine speed to match output demand, while also varying heat input to the engine. This assures high efficiency operation over a wide range of engine outputs.

In the FIG. 2 presentation, there are two equal and opposed power pistons 30. They are illustrated as being coaxial and arranged at opposite sides of an axis extending along the center of displacer cylinder 12 and counterbalance 43.

The power pistons 30 shown in FIG. 2 have equal masses and act in symmetrical opposition, thereby producing no vibration of the engine housing 20. The displacer components and counterweight components have equal masses and act in symmetrical opposition, so they likewise produce no vibration of the engine housing 20. This symmetrical arrangement of the moving components provides balance to the working machine elements, but is not crucial to the basic displacer control system that is the primary subject of this disclosure.

Displacer drive rod 21 is hydrostatically coupled to the counterbalance rod 22, which is constrained by the stabilizer 23. The illustrated use of a scotch yoke mechanism as the stabilizer 23 eliminates the secondary lateral vibrational or inertial forces across the displacer axis that a connecting rod would produce.

Advantages of the engine concept shown in FIGS. 1 and 2 include excellent stability and control, hermetic sealing of working gas, adaptation to demonstrated internal lubrication and hydraulic fluid makeup systems, perfect linear balance, high efficiency, operational reliability and long life, effective displacer clearance seals, fully unattended operation, good manufacturability, good maintainability, low cost, and compatibility with commercial hydraulic motors and rotary induction generators for connection to a power grid.

The apparatus shown in FIGS. 1 and 2 can be compared with alternative Stirling engine/linear alternator concepts where a free floating displacer is pneumatically coupled to a power piston that produces electrical power as a direct function of its reciprocation. While the gas heater, gas cooler, regenerator and displacer for both systems can be conceptually identical, the displacer drives are substantially different. It is typical is such alternative machines to have a drive rod that resonates through a gas clearance seal against a displacer gas spring with no positive means of amplitude stabilization and control. The displacer of the present free piston Stirling engine is hydraulically coupled to a displacer gas spring by means of the stabilizer, which mechanically controls displacer amplitude. Throttling of this hydraulic coupling flow by operation of a valve provides a remarkably simple and energy efficient method of engine speed and power control.

Figure 3:
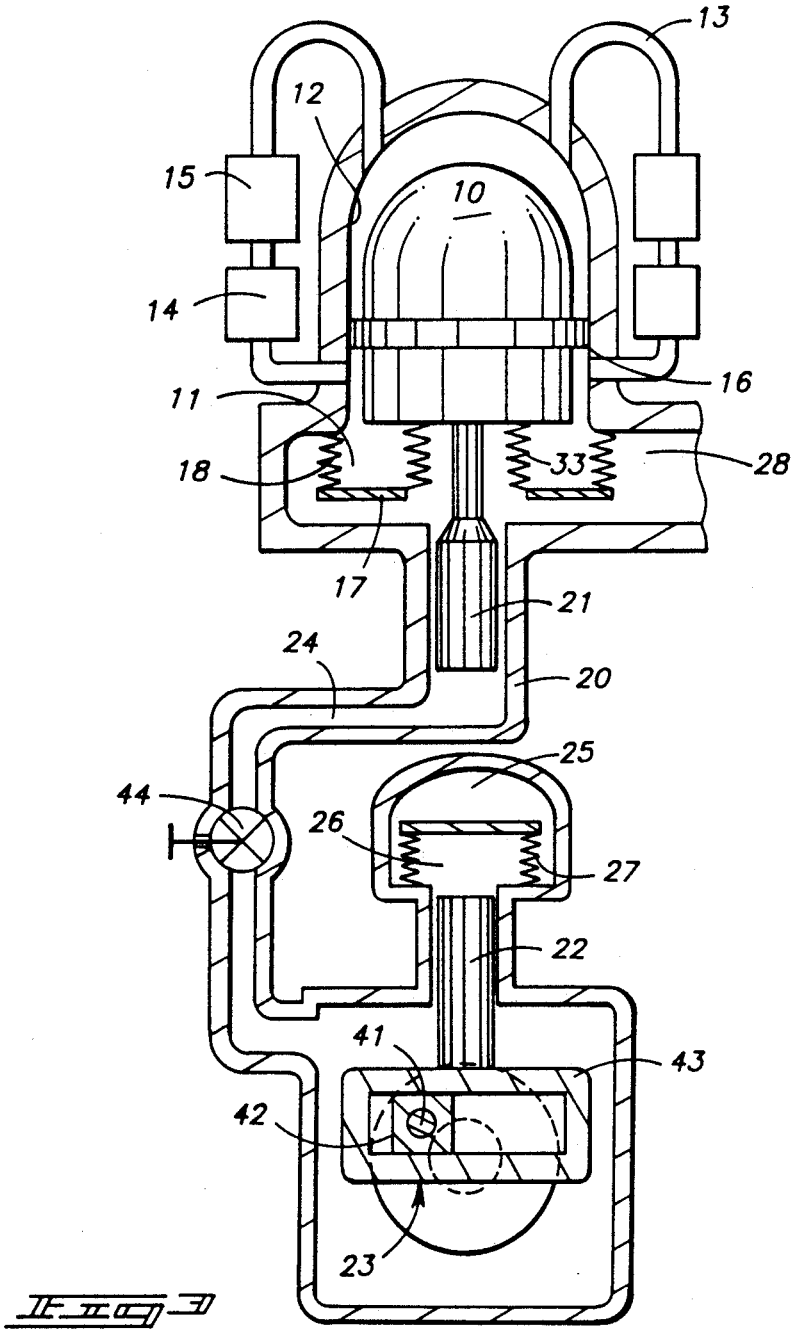
FIG. 3 is an additional simplified view of another form of the machine.

FIG. 3 is basically identical to FIG. 2, but illustrates an alternative placement of valve 44 in the primary hydraulic circuit. While valve 44 was interposed in the path of hydraulic fluid 26 in FIG. 2, it is interposed within the path of the hydrostatic fluid 24 in FIG. 3. In all other respects, the structure and operation of the machine is as previously described.

Figure 4:
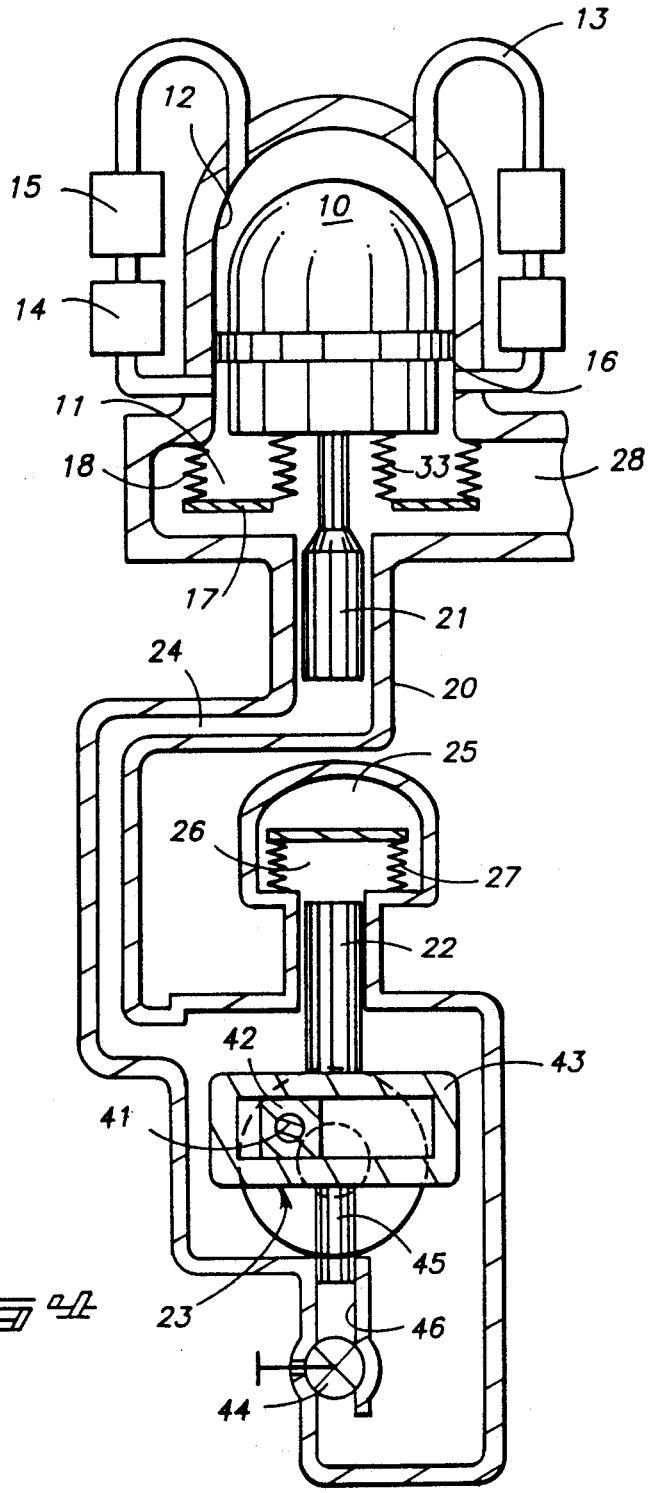
FIG. 4 is a simplified view of a preferred form of the machine.
Figure 5:
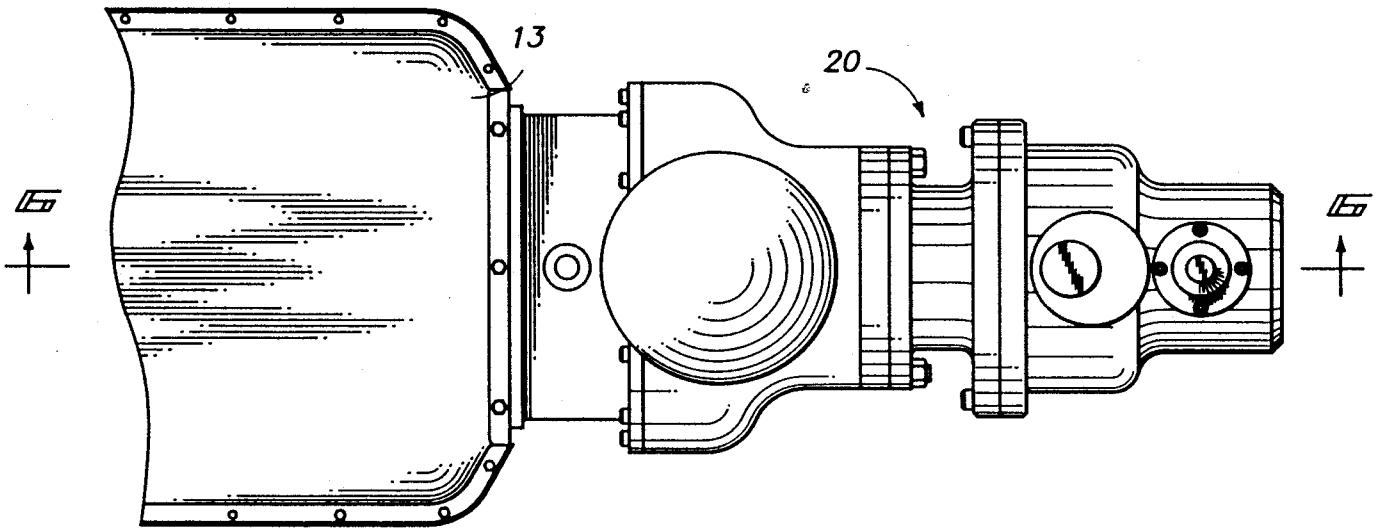
FIG. 5 is an elevation view of the preferred machine.
Figure 5:
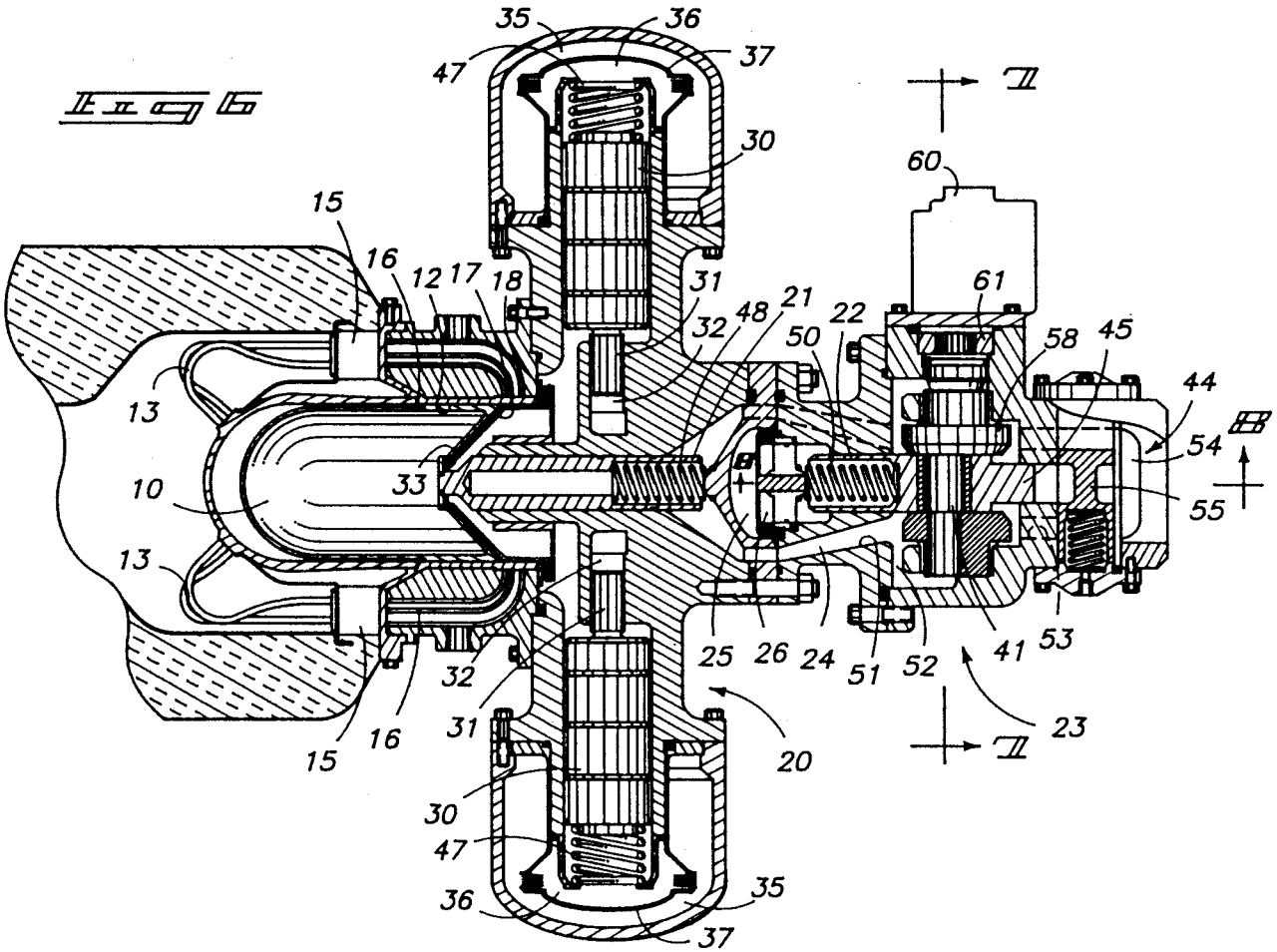
Figure 7:
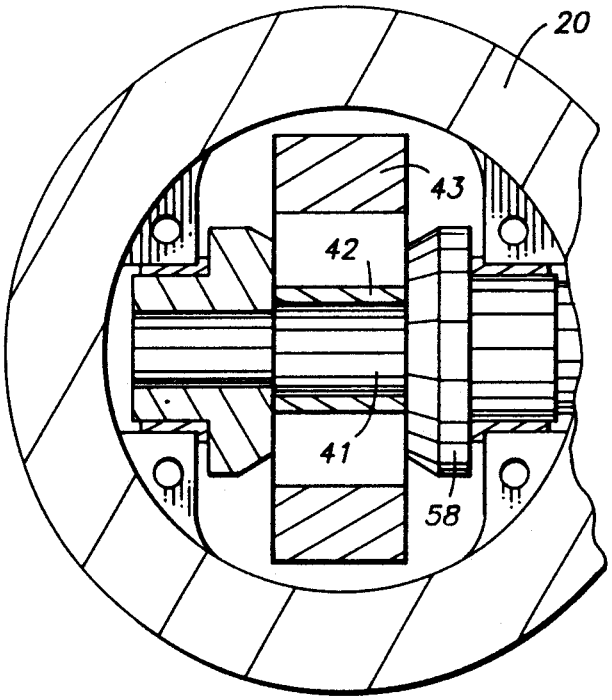
FIG. 7 is an enlarged sectional view taken along line 7—7 in FIG. 6.
Figure 11:
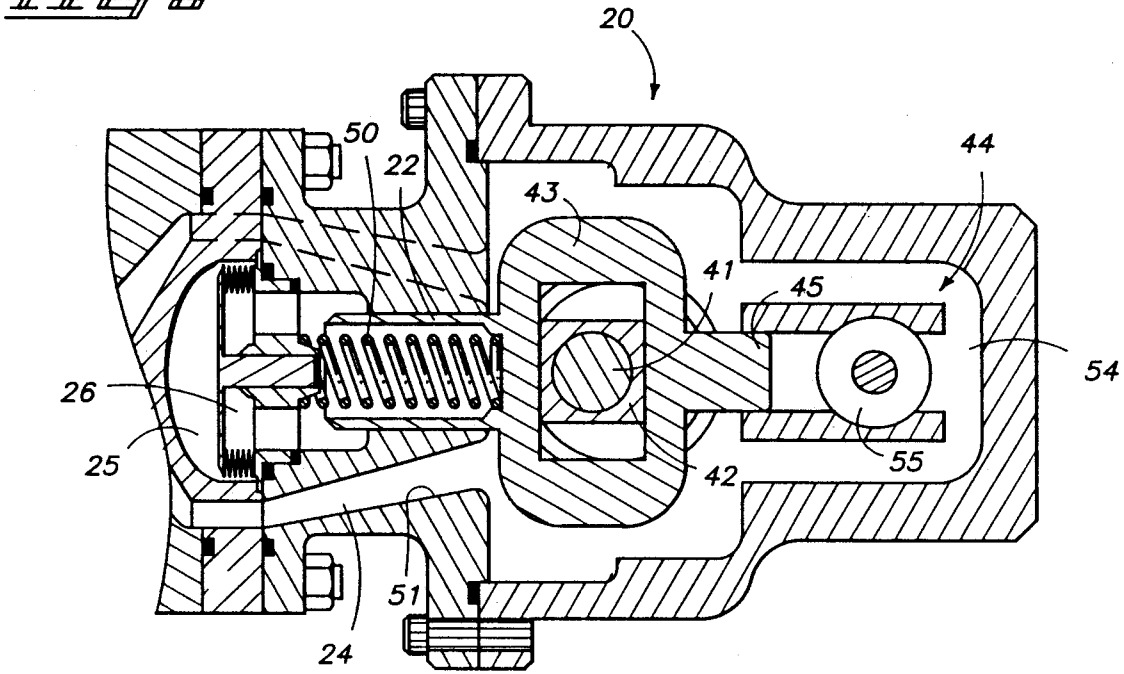

FIG. 4 shows an additional variation of the machine structure. The scotch yoke includes a reciprocating cylindrical guide rod 45 that slides within a cylindrical passageway 46. A portion of the hydrostatic fluid 24 is directed to the bottom or outer end of guide rod 45 through the passageway 46, which includes the previously-described control valve 44. The structure and operation of the engine is basically identical to that previously described.

FIGS. 5–8 detail a preferred mode of the invention developed about the illustration in FIG. 4. Again, the previously-described elements and reference numerals are applied to the disclosure in these figures, where applicable.

Light compression springs 47 are shown in FIG. 6 engaged against the outer ends of the power pistons 30. The springs 47 are substantially overpowered by the hydraulic forces exerted on power pistons 30 by the secondary hydraulic fluid 28 during operation of the engine. The purpose of springs 47 is to return the power pistons 30 to their innermost positions when the engine is inoperative. Similarly, light compression springs 48 and 50 are engaged with the outer ends of the displacer drive rod 21 and counterbalance rod 22, respectively. Their only purpose again is to bias these elements to an initial starting position when the engine is inoperative.

The volume of hydrostatic fluid 24, which is displaced by reciprocation of displacer drive rod 21 within housing 20, is directed through horizontally arcuate channels 51 to the sealed chamber 52 that houses stabilizer 23. The lower end of chamber 52 has hydraulic fluid openings 53 that are directed to the lower fluid chamber 54 for valve 44. Valve 44 includes a reciprocable spool 55 that can be shifted axially. The axial position of spool 55 at any time during operation of the engine determines the restriction of fluid flow between the fluid chamber 54 and the lower end of guide 45. Movement of spool 55 can be accomplished by means of a conventional electrical, hydraulic, pneumatic or mechanical linear actuator, which can be automatically responsive to any desired control system.

The above description and accompanying drawings have been simplified to emphasize the structural and operational features of the improved free piston Stirling machine. It is to be understood that control of the hydraulic fluid volume within the primary hydraulic fluid circuit is necessary to assure proper reciprocating motion of displacer 10 within the displacer cylinder 12. Such control might be provided by valve means or ports (not shown) actuated by the axial position of displacer drive rod 21 within housing 20. The valve means or ports should be arranged to operate when the displacer reaches its desired end-of-stroke positions. These valve means can be effectively coupled to a reservoir for excess fluid (dump port/valve) or to a source of pressurized fluid (makeup port/valve).

Starting of the engine is accomplished by means of a conventional motor 60. Motor 60 can be electrical, pneumatic or hydraulic. It is coupled to crank 58 of the scotch yoke mechanism through a conventional clutch 61. Clutch 61 is actuated only during initial starting of the engine.

A key advantage of the present machine concept is a remarkably simple engine control system which varies engine frequency, thereby modulating heat input temperature and maximizing cyclic power output. High efficiency therefore can be attained over a wide range of heat inputs to the engine. If heater head temperature is not precisely controlled in this type of Stirling engine, heater head failure or decreased efficiency will result.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

What is claimed:

1. A free piston Stirling cycle machine, comprising:

a displacer cylinder having a central cylindrical axis;

a displacer located within the displacer cylinder and movably mounted along the axis;

an enclosed gas spring;

working gas means including an enclosed volume of pressurized working gas directed to opposite axial ends of the displacer for cyclically reciprocating the displacer along its axis in a Stirling cycle mode of operation;

counterbalance means mounted for axial motion directly related to that of the displacer, stabilizer means mechanically coupled to the counterbalance means for cyclically constraining reciprocating axial motion of the counterbalance means in a repetitive pattern; and hydrostatic fluid means operatively coupling the counterbalance means to the gas spring for accommodating fluid volumetric displacement due to engine operation, the hydrostatic fluid means also being operably coupling the displacer and counterbalance means for imparting axial movement between them.

2. The free piston Stirling cycle machine of claim 1, further comprising:

movable power means hydrostatically coupled to the working gas means for extraction of net cyclic work between them.

3. The free piston Stirling cycle machine of claim 1, further comprising:

throttle valve means interposed in the hydrostatic fluid means for adjustably resisting displacer motion.

4. The free piston Stirling cycle machine of claim 1 wherein the gas spring is connected to the hydrostatic fluid means for accommodating fluid volumetric displacement due to engine operation.

5. The free piston Stirling cycle machine of claim 1, wherein the stabilizer means comprises a scotch yoke mechanism movably supporting the counterbalance.

6. A free piston Stirling cycle machine, comprising:

a displacer cylinder having a central cylindrical axis;

a displacer located within the displacer cylinder and movably mounted along the axis;

an enclosed gas spring;

working gas means including an enclosed volume of pressurized working gas directed to opposite axial ends of the displacer for cyclically reciprocating the displacer along its axis in a Stirling cycle mode of operation;

a displacer drive rod fixed to the displacer;

counterbalance means movably mounted for reciprocating motion coaxially with the displacer;

stabilizer means mechanically coupled to the counterbalance means for cyclically constraining reciprocating axial motion of the counterbalance means in a repetitive pattern;

hydrostatic fluid means operably coupling the counterbalance means to the gas spring for accommodating fluid volumetric displacement due to engine operation, the hydrostatic fluid means also being operably connected between the displacer drive rod and counterbalance means for imparting equal and opposite axial movement to them; and movable power means for extraction of net cyclic work as a direct function of working gas pressure fluctuations.

7. The free piston Stirling machine of claim 6 further comprising:

a throttle valve interposed in the hydrostatic fluid means for adjustably resisting displacer motion.

8. The free piston Stirling cycle machine of claim 6, wherein the stabilizer means comprises a scotch yoke mechanism.

9. The free piston Stirling cycle machine of claim 6, wherein the power means comprises:

at least one piston movably mounted along an axis.

10. The free piston Stirling cycle machine of claim 6, wherein the power means comprises:

a pair of pistons movably mounted in direct opposition to one another along a common axis, the pistons having equal masses.

11. A free piston Stirling cycle engine, comprising:

a housing;

a displacer cylinder formed in the housing and having a central cylindrical axis;

a displacer located within the displacer cylinder, the displacer having an annular clearance seal formed about it that movably mounts the displacer within the displacer cylinder;

an enclosed gas spring;

working gas means including an enclosed volume of pressurized working gas directed to opposite sides of the annular clearance seal formed on the displacer for cyclically reciprocating the displacer along its axis in a Stirling cycle mode of operation;

a coaxial displacer drive rod fixed to the displacer and movably guided in the housing by an annular clearance seal surrounding it;

a coaxial counterbalance movably guided in the housing by an annular clearance seal surrounding it for reciprocating motion along the central cylindrical axis of the displacer;

stabilizer means mechanically coupled to the counterbalance means for cyclically constraining reciprocating axial motion of the counterbalance means in a repetitive pattern;

first hydrostatic fluid means operably coupling the counterbalance means to the gas spring for accommodating fluid volumetric displacement due to engine operation, the first hydrostatic fluid means also being operably connected between the displacer and counterbalance for imparting equal and opposite axial movement to them; and a power piston movable axially in response to cyclic changes in working gas pressure to thereby deliver net power externally to the engine.

12. The free piston Stirling cycle engine of claim 11, further comprising:

second hydrostatic fluid means operably connected between the displacer and the power piston for imparting motion to the power piston as a direct function of cyclic changes in working gas pressure.

* * * * *